US012274905B2

(12) United States Patent
Lupoli et al.

(10) Patent No.: US 12,274,905 B2
(45) Date of Patent: Apr. 15, 2025

(54) SLIDING LOCK BARBELL ADAPTER

(71) Applicant: Living Lean Consulting LLC, Chagrin Falls, OH (US)

(72) Inventors: Peter Lupoli, Bethany, CT (US); Mark A. Derry, Chagrin Falls, OH (US); William Harrington, Newtown, CT (US)

(73) Assignee: Living Lean Consulting LLC, Chagrin Falls, OH (US)

( * ) Notice: Subject to any disclaimer, the term of this patent is extended or adjusted under 35 U.S.C. 154(b) by 0 days.

(21) Appl. No.: 17/816,694

(22) Filed: Aug. 1, 2022

(65) Prior Publication Data

US 2024/0033556 A1 Feb. 1, 2024

(51) Int. Cl.
*A63B 21/072* (2006.01)
*A63B 21/00* (2006.01)

(52) U.S. Cl.
CPC ..... *A63B 21/0724* (2013.01); *A63B 21/4035* (2015.10)

(58) Field of Classification Search
None
See application file for complete search history.

(56) References Cited

U.S. PATENT DOCUMENTS 4,768,780 A * 9/1988 Hayes ..... A63B 21/0724 482/106
8,574,136 B1 * 11/2013 Burstrom ..... A63B 21/0724 482/109
9,731,159 B2 * 8/2017 Reynolds ..... A63B 21/4035
10,004,970 B1 * 6/2018 Mailander ..... A63B 21/4035
10,086,225 B2 * 10/2018 Sheppard ..... A63B 21/0728
10,792,534 B2 * 10/2020 Klecka ..... A63B 21/0724
11,130,013 B2 * 9/2021 Tabone ..... A63B 21/0724
11,383,123 B2 * 7/2022 Reibman ..... A63B 21/0724
11,383,125 B2 * 7/2022 Martinez ..... A63B 21/0726
11,752,385 B2 * 9/2023 Abbott ..... A63B 21/0722 482/106
2006/0252612 A1 * 11/2006 Melcer ..... A63B 23/0405 482/139
2009/0325769 A1 * 12/2009 Miskel ..... A63B 21/075 482/107
2011/0173778 A1 * 7/2011 Wales ..... B25G 3/20 16/426
2014/0024506 A1 * 1/2014 Vixathep ..... A63B 21/0726 482/108
2018/0140890 A1 * 5/2018 Sheppard ..... A63B 21/0728
2019/0351280 A1 * 11/2019 Klecka ..... A63B 21/0726
2019/0351281 A1 * 11/2019 Monarrez, Jr. .... A63B 21/4035
2020/0114193 A1 * 4/2020 Tabone ..... A63B 21/0783
2020/0188723 A1 * 6/2020 Reibman ..... A63B 21/0724

* cited by examiner

*Primary Examiner* — Joshua Lee
(74) *Attorney, Agent, or Firm* — Michael L. Greenberg, Esq.; Greenberg & Lieberman, LLC

(57) ABSTRACT

A sliding lock barbell adapter is disclosed. The adapter is configured to quickly convert a standard barbell into one that can perform multiple exercises safely and with proper form. The adapter is preferably made from tubular steel with a lower and upper jaw positioned in a unique manner allowing for proper body form and comfort while exercising with reduced risk of injury. The positioning of the jaw allows for the spring-loaded locking pins to pivot the bar in place. Additionally, foam interior padding increases slip resistance and comfort.

14 Claims, 3 Drawing Sheets

SLIDING LOCK BARBELL ADAPTER

CONTINUITY

This application is a non-provisional patent application of provisional patent application No. 63/227,379, filed on Jul. 30, 2021, and priority is claimed thereto.

FIELD OF THE PRESENT INVENTION

The present invention relates to the safety of human mobility while performing exercises, and more specifically relates to a sliding lock barbell adapter configured to provide a secure connection to a conventional barbell, reducing the risk of injury for a user.

BACKGROUND OF THE INVENTION

Some commonly performed weightlifting movements cannot be performed safely and with proper form using a standard barbell. Limited mobility of the person doing the exercise can cause pain and/or lead to improper form when performing the exercise. Unfortunately, this improper form can lead to discomfort and/or serious injury.

Current customized barbells for performing the Front Squat and the Barbell Carry have welded members that cannot be removed. These special barbells require the user to purchase and store multiple barbells that are for specific movements only. This drastically increases the expense of barbell workouts. If there were a more versatile design which could accommodate a barbell while remaining adjustable such that they are conducive to the performance of exercises such as the Front Squat and the Barbell Carry, such exercises could be performed in a safer fashion, preventing injury.

Thus, there is a need for a new form of barbell adapter accessory configured to quickly convert a standard barbell into one that is capable of performing multiple exercises safely and with proper form. Such an apparatus is preferably configured to be removably affixed to a conventional barbell to enable the user to perform a variety of exercises safely while maintaining proper form.

SUMMARY OF THE PRESENT INVENTION

The present invention is a sliding lock barbell adapter which is configured to quickly and easily provide a secure connection to a standard barbell that, when attached, allows the user to perform a variety of movements in a neutral body position with proper form to ensure a reduced risk of injury.

It is known that standard barbells are painful and difficult to use for many users when performing certain exercises. Custom barbells are expensive and can only be used to perform a single exercise for which they were designed. In contrast, the present invention can quickly adapt any standard barbell into a safe and effective barbell for performing multiple exercises (including but not limited to the Front Squat and The Barbell Carry or Farmer's Carry or Suitcase Carry) without the need of dedicated custom barbells for each exercise.

The present invention can quickly convert a standard barbell into one that is capable of performing multiple exercises safely and with proper form.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

Figure 1:
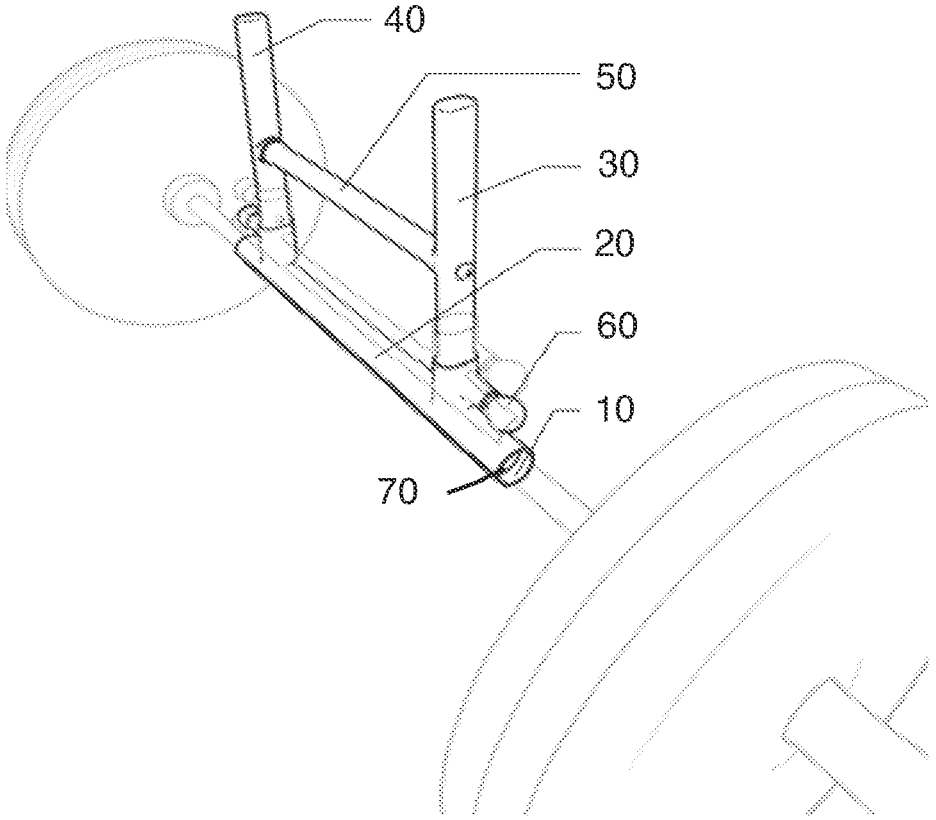
FIG. 1 exhibits a view of the barbell adapter of the present invention as seen from the front.
Figure 2:
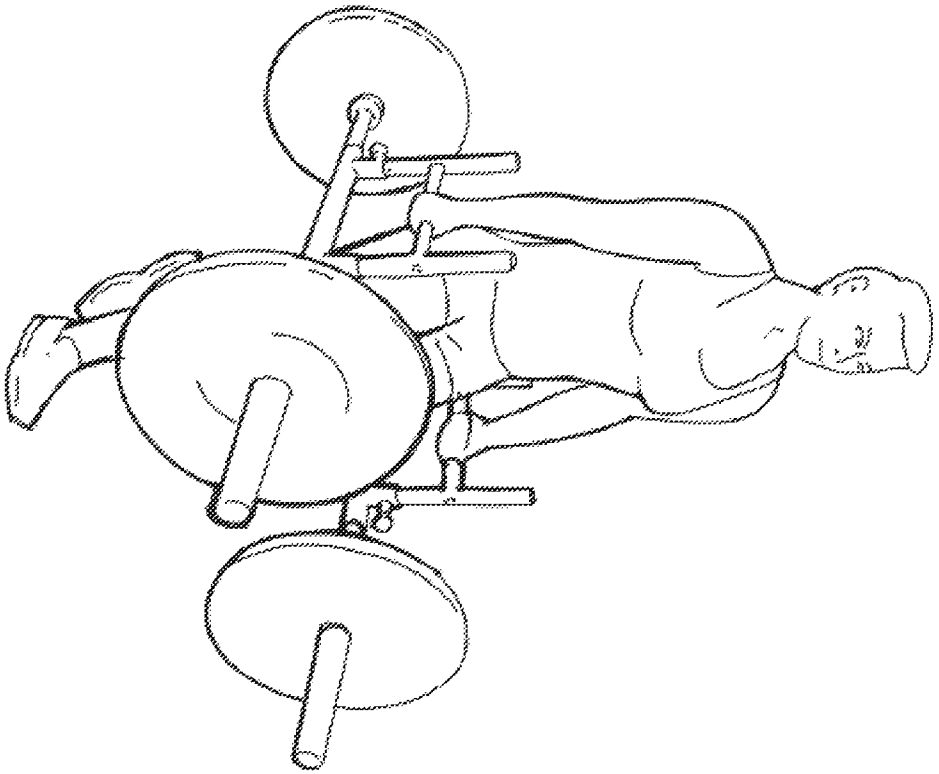
FIG. 2 depicts a view of the barbell adapter of the present invention as seen from the side in use by a user to perform the Barbell Carry exercise.
Figure 3:
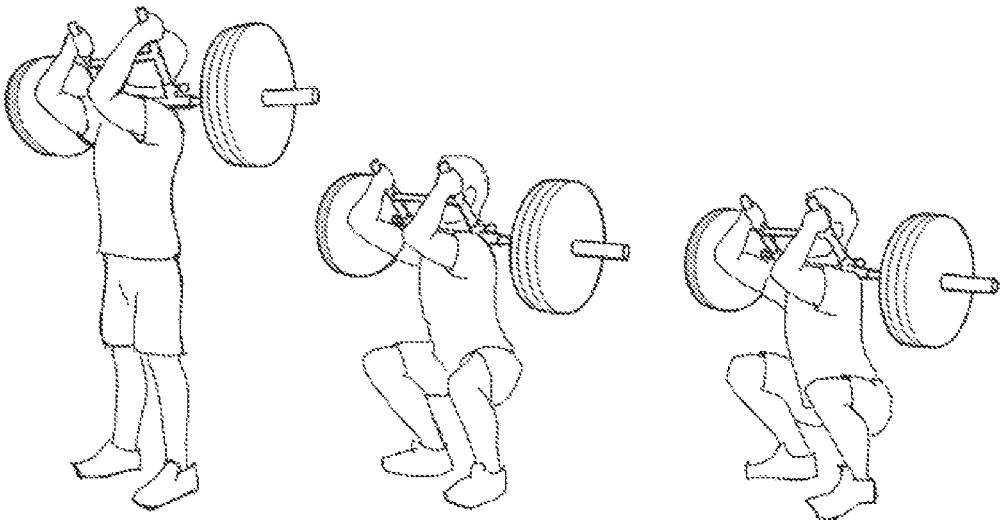
FIG. 3 a view of the barbell adapter of the present invention as seen from the side in use by a user to perform the Front Squat exercise.

The present specification discloses one or more embodiments that incorporate the features of the invention. The disclosed embodiment(s) merely exemplify the invention. The scope of the invention is not limited to the disclosed embodiment(s). The invention is defined by the claims appended hereto.

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to affect such feature, structure, or characteristic in connection with other embodiments whether or not explicitly described.

The present invention is a multi-exercise device, referenced as a sliding lock barbell adapter, which can be used to perform at least two popular exercises. The sliding lock barbell adapter, in one embodiment, is made from tubular steel with a lower jaw (10) consisting of a radius machined from tube steel and welded, to the left and right perpendicular handles. The sliding upper jaw (20) is preferably made of welded and machined tube steel with spring loaded locking pins, oriented perpendicular to the sliding portion of upper jaw (20). The connecting handle (50) is perpendicular to and attached between left handle (30) and right handle (40) by conventional bolts.

Disengaging the spring-loaded pins (60) creates an open state for the lower jaw (10) relative to the upper jaw (20). This open position can allow the user to position a standard weightlifting barbell between lower jaw (10) and upper jaw (20). Sliding the upper jaw (20) down toward the weightlifting bar will cause the locking pins (60) to engage into the left handle (30) and right handle (40) and create a secure connection over a weightlifting barbell (or similar object). The left handle (30) and Right Handle (40) serve as comfort handles when performing certain weightlifting movement such as (but not limited to) the "front squat". The connecting handle (50) is positioned in the same plane but higher up than the lower jaw (10) and upper jaw (20) providing a second comfort handle for safely conducting other weight lifting movements such as (but not limited to) the barbell carry, farmers carry, or suitcase carry). The Interior padding (70) provides is made of foam (or various other materials) that provides increased slip resistance of the weightlifting bar when contacted by the upper (20) and lower jaws (10).

To use the present invention, a user must first release the spring-loaded locking pins (60) to put the lower jaw (10) in an open position relative to upper jaw (20). Position weightlifting barbell or similar object parallel to and in between lower jaw (10) and upper jaw (20). Release locking pins (60) engaged in both left handle (30) and right handle (40) to allow sliding upper jaw (20) to fit over and lock into corresponding holes in the left handle (30) and right handle (40) to establish the closed clamshell like position. At this point, this device is ideally positioned to perform multiple weightlifting movements such as the front squat, farmers carry, barbell carry, suitcase carry, or others.

To perform the front squat exercise, the user will lift the barbell from the floor to the "starting position" pictured below as they would do if our device was not attached. Once in the starting position, the barbell can be rotated so that Left Handle (3) and Right Handle (4) are pointed away from the user and angled upward. While holding Left Handle (3) and Right Handle (4) with the users left and right hand respectively, the front squat movement can be performed with the optimal form without causing the wrist and should pain/mobility issue that would lead to the poor form pictured below and called "Form Mistake"

To perform the Barbell Carry exercise, the user must first start with the barbell loaded and positioned on the floor. Then, the user will squat down and grasp the device from the Connecting Handle (50). This is commonly performed with a single barbell in one hand as shown below and also with two barbells, one in the left hand and one in the right hand. In the latter scenario, two barbells would be setup each using a Sliding Lock Barbell Adapter (the product). After grasping the Connecting Handle (50) with one or two hands, the user will stand up and thereby lift the weighted barbell from the floor. At this stage the user will walk forward while carrying the barbell(s) while using their wrist strength to attempt to keep the barbell(s) parallel to the ground. When using our device, the point of rotation moves from the user's wrists (as pictured) to a much more effective point of rotation formed by the Left Handle (30) and Right Handle (40) connected by Connecting Handle (50). An additional benefit of our product is that the user does not have to squat down as far to grasp the bar since the Connecting Handle (50) is positioned closer to the user's hands then the barbell which is positioned closer to the floor or further from the user.

The present invention is preferably constructed from durable materials. Lower jaw (10) is made from steel or other material (such as aluminum, plastic, or similar) with a left handle (30) and right handle (40) attached by welding or any other attachment mechanism. Upper jaw (20) is made from steel or other material (such as aluminum, plastic, or similar) and can slide over left handle (30) and right handle (40) forming a clamshell like attachment over a standard weightlifting barbell or similar object. Locking pins (60) are added to upper sliding upper jaw (20) and engage into corresponding holes in both left handle (30) and right handle (40). Connecting handle (50) is than attached to left handle (30) and right handle (40) by standard connection hardware, welding, or similar mechanism. Interior slip resistant padding (70) is attached to upper or lower jaw using adhesive or similar attachment mechanism.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

Further, it should be understood that the present invention exhibits the following components:

The current invention includes:

1. Lower Jaw (10)
2. Sliding Upper Jaw (20)
3. Left handle perpendicular to lower and upper jaws (30)
4. Right handle perpendicular to lower and upper jaws (40)
5. Connecting handle parallel to lower and upper jaws (50)
6. Spring loaded locking pins (60)
7. Interior slip resistant padding (70)

The lower jaw (10) is attached to both the left or right handle as a single piece or by some method of attachment. The upper jaw (20) can slide up and down on a left handle (30) and a right handle (40) to form a clam shell-like closure over a weightlifting barbell or similar device. Using the Spring-loaded locking pins (60) engaged in a hole within left handle (30) and right handle (40), a secure closure overweight lifting bar or similar device is established. Connecting handle (50) is affixed to both left handle (30) and right handle (40) creating a rigid connecting member between the left handle (30) and the right handle (40). Interior slip resistant padding (70) is preferably attached in either the lower jaw and/or upper jaw to provide a secondary surface of higher slip resistance than the jaw itself.

We claim:

1. A sliding lock barbell adapter configured to connect to a handle of a barbell comprising:

a lower jaw;

a sliding upper jaw, said sliding upper jaw disposed adjacent to said lower jaw;

wherein said lower jaw and said sliding upper jaw are configured to circumscribe the handle of the barbell securely such that the barbell cannot move laterally between said lower jaw and said sliding upper jaw;

a left handle, said left handle disposed perpendicularly to said lower jaw and said sliding upper jaw;

a right handle, said right handle disposed perpendicularly to said lower jaw and said sliding upper jaw;

a connecting handle, said connecting handle disposed parallel to said sliding upper jaw and said lower jaw;

a first locking pin, said first locking pin disposed on said sliding upper jaw, in removable communication with said left handle; and a second locking pin, said second locking pin disposed on said sliding upper jaw in removable communication with said right handle.

2. The sliding lock barbell adapter of claim 1, wherein said first locking pin and said second locking pin are disposed under said connecting handle.

3. The sliding lock barbell adapter of claim 2, further comprising:

interior slip resistant padding, said interior slip resistant padding disposed on said sliding upper jaw and on said lower jaw;

wherein said interior slip resistant padding is disposed between the barbell and the sliding upper jaw; and wherein said interior slip resistant padding is disposed between the barbell and the lower jaw.

4. The sliding lock barbell adapter of claim 3, wherein said interior slip resistant padding is compressed when said sliding upper jaw is closed against said lower jaw around the barbell.

5. The sliding lock barbell adapter of claim 3, wherein said first locking pin and said second locking pin are spring-loaded.

6. The sliding lock barbell adapter of claim 2, wherein said first locking pin and said second locking pin are spring-loaded.

7. The sliding lock barbell adapter of claim 2, wherein said right handle is parallel to said left handle.

8. The sliding lock barbell adapter of claim 1, further comprising:

interior slip resistant padding, said interior slip resistant padding disposed on said sliding upper jaw and on said lower jaw;

wherein said interior slip resistant padding is disposed between the barbell and the sliding upper jaw; and wherein said interior slip resistant padding is disposed between the barbell and the lower jaw.

9. The sliding lock barbell adapter of claim 8, wherein said interior slip resistant padding is compressed when said sliding upper jaw is closed against said lower jaw around the barbell.

10. The sliding lock barbell adapter of claim 1, wherein said first locking pin and said second locking pin are spring-loaded.

11. The sliding lock barbell adapter of claim 1, wherein said right handle is parallel to said left handle.

12. A sliding lock barbell adapter configured to connect to a handle of a barbell comprising:

a lower jaw;

a sliding upper jaw, said sliding upper jaw disposed adjacent to said lower jaw;

wherein said lower jaw and said sliding upper jaw are configured to circumscribe the handle of the barbell securely such that the barbell cannot move laterally between said lower jaw and said sliding upper jaw;

a left handle, said left handle disposed perpendicularly to said lower jaw and said sliding upper jaw;

a right handle, said right handle disposed perpendicularly to said lower jaw and said sliding upper jaw;

a connecting handle, said connecting handle disposed parallel to said sliding upper jaw and said lower jaw;

interior slip resistant padding, said interior slip resistant padding disposed on said sliding upper jaw and on said lower jaw;

wherein said interior slip resistant padding is disposed between the barbell and the sliding upper jaw;

wherein said interior slip resistant padding is disposed between the barbell and the lower jaw;

wherein said interior slip resistant padding is configured to compress when said sliding upper jaw is closed against said lower jaw;

a first locking pin, said first locking pin disposed on said sliding upper jaw, in removable communication with said left handle; and a second locking pin, said second locking pin disposed on said sliding upper jaw in removable communication with said right handle.

13. The sliding lock barbell adapter of claim 12, wherein said first locking pin and said second locking pin are disposed under said connecting handle.

14. The sliding lock barbell adapter of claim 13, wherein said right handle and said left handle extend up beyond said connecting handle.

* * * * *